US007530374B2

(12) United States Patent
Martin

(10) Patent No.: US 7,530,374 B2
(45) Date of Patent: May 12, 2009

(54) SYSTEM FOR FILLING A CONTAINER

(75) Inventor: Carl Martin, Millersburg, PA (US)

(73) Assignee: Advanced Scientifics, Inc., Millersburg, PA (US)

( * ) Notice: Subject to any disclaimer, the term of this patent is extended or adjusted under 35 U.S.C. 154(b) by 152 days.

(21) Appl. No.: 11/694,365

(22) Filed: Mar. 30, 2007

(65) Prior Publication Data

US 2007/0277904 A1 Dec. 6, 2007

Related U.S. Application Data

(60) Provisional application No. 60/803,403, filed on May 30, 2006.

(51) Int. Cl.
*B67C 3/26* (2006.01)
*B65B 3/04* (2006.01)

(52) U.S. Cl. ..... 141/90; 141/5; 141/91; 141/193; 141/263; 141/346; 222/153.04

(58) Field of Classification Search ..... 141/5, 141/85, 89–91, 146–147, 192–193, 263–264, 141/332–333, 346–347, 383–384, 390, 392; 137/383, 798; 222/74, 153.01, 153.04, 153.13, 222/153.14
See application file for complete search history.

(56) References Cited

U.S. PATENT DOCUMENTS

| | | | | |
|---|---|---|---|---|
| 1,322,076 | A * | 11/1919 | Wheaton | 137/383 |
| 3,926,229 | A | 12/1975 | Scholle | |
| 4,212,414 | A * | 7/1980 | Beyens | 141/91 |
| 4,350,187 | A * | 9/1982 | Trusselle et al. | 141/90 |
| 4,460,025 | A * | 7/1984 | Scholle et al. | 141/1 |
| 4,667,709 | A * | 5/1987 | Fischer et al. | 141/91 |
| 5,343,907 | A * | 9/1994 | Wagner | 141/89 |
| 5,524,683 | A * | 6/1996 | Mueller | 141/129 |
| 6,941,986 | B2 * | 9/2005 | Hoeppner | 141/329 |
| 6,957,781 | B2 * | 10/2005 | Gowens et al. | 239/112 |
| 2004/0129338 | A1 * | 7/2004 | Rohret et al. | 141/89 |

FOREIGN PATENT DOCUMENTS

| | | |
|---|---|---|
| EP | 0088735 | 9/1983 |
| WO | WO 99/39978 | 8/1999 |

* cited by examiner

*Primary Examiner*—Timothy L Maust
*Assistant Examiner*—Nicolas A Arnett
(74) *Attorney, Agent, or Firm*—Philip D. Freedman PC; Philip D. Freedman

(57) ABSTRACT

A system (10) and method for substantially automatically aseptically or non-aseptically filling a container with a fluid. The transfer of fluid occurs via a movable nozzle mechanism (20) substantially automatically inserted into a side opening (32) in a connector (12) attached to the container. More specifically, the side opening (32) in the connector (12) is exposed, the nozzle mechanism (20) is moved into the side opening (32), the fluid is transferred into the container via the nozzle mechanism (20) and the connector (12), the nozzle mechanism (20) is removed from the side opening (32) in the connector (12), and the side opening (32) in the connector (12) is closed. The aseptic transfer of fluid includes a substantially automatic sterilization procedure accomplished by both spray and contact components (54,56).

20 Claims, 8 Drawing Sheets

SYSTEM FOR FILLING A CONTAINER

RELATED APPLICATIONS

The present U.S. non-provisional patent application is related to and claims priority benefit of an earlier-filed U.S. provisional patent application of the same title, Ser. No. 60/803,403, filed May 30, 2006. The identified earlier-filed provisional application is incorporated by reference herein.

BACKGROUND OF THE INVENTION

1. Field of the Invention

The present invention relates broadly to systems and methods for filling containers. More specifically, the present invention concerns a system and method for substantially automatically aseptically or non-aseptically filling a container with a fluid, wherein the transfer of fluid occurs via a movable nozzle mechanism substantially automatically inserted into a side opening in a connector attached to the container, and wherein the aseptic transfer of fluid includes a substantially automatic sterilization procedure.

2. Background of the Invention

It is often desirable to quickly and efficiently fill containers with fluids. To that end, systems are available for transferring liquids from large capacity sterile or otherwise controlled environments to smaller containers for sale and consumption. These systems generally involve establishing and maintaining the same controlled environment within a transfer conduit extending between the source and the container.

Unfortunately, these systems suffer from a number of disadvantages with regard to maintaining the controlled environment within the transfer conduit while accomplishing the transfer as quickly and efficiently as possible. For example, some such systems utilize disposable, single-use tubing as the transfer conduit, which requires that the tubing be replaced before each transfer. Other such systems utilize filling chambers lined with disposable liners which must be properly positioned, sealed, and validated prior to filling and then removed following filling. Still other such systems rely on undesirably complex and expensive valve mechanisms at one or both ends of the conduit, or transfer the fluid in such an uncontrolled manner as to result in significant waste and require a separate cleaning step prior to completion.

Due to these and other problems and limitations of the prior art, a need exists for an improved system and method for quickly and efficiently filling containers with fluids.

SUMMARY OF THE INVENTION

The present invention overcomes the above-discussed and other problems and limitations of the prior art by providing an improved system and method for quickly and efficiently filling containers with a fluids.

In one embodiment, the system of the present invention comprises a connector attached to the container and including a fitting having a side opening, and a filling machine including a nozzle mechanism which is movable to enter the side opening and transfer the fluid through the connector and into the container. The fitting may include an upper fitting portion and a lower fitting portion which cooperate to expose the side opening for filling the container, and which cooperate to block the side opening once the container is filled. The fitting may further include a top surface which is puncturable or otherwise openable to access the fluid within the filled container.

In one embodiment, the connector includes a locking mechanism positioned over the fitting. The locking mechanism may include one or more external side channels for cooperating with a cap.

In one embodiment, the filling machine further includes a removal mechanism for removing the locking mechanism from the fitting to expose the side opening for filling the container, and for replacing the locking mechanism once the container is filled.

In one embodiment, the filling machine further includes a filling chamber including an outer body including a bottom opening for receiving at least a portion of the connector, and a side opening for receiving the nozzle mechanism, and an inner body slidably received within the outer body and movable between a first position in which the inner body blocks the side opening in the outer body, and a second position in which the inner body does not block the side opening in the outer body. In this embodiment, the nozzle mechanism includes a shaft movable between a first position in which the shaft extends through the side opening in the outer body of the filling chamber and into the side opening in the connector, and a second position in which the shaft is retracted and the side opening in the outer body of the filling chamber is blocked by the inner body.

In one embodiment the filling machine includes a sterilization mechanism for sterilizing the connector and the filling chamber, the sterilization mechanism including a sprayer component for spraying a sterilizing liquid into the filling chamber, an evacuation component for evacuating an airborne portion of the sterilizing liquid prior to filling the container, and a contact component for applying the sterilizing liquid directly to at least a portion of the connector. The contact component may also apply the sterilizing liquid directly to at least a portion of the nozzle mechanism. The sprayer component may receive the sterilizing liquid from a reservoir, and the contact component may wick the sterilizing liquid from the reservoir.

From the present disclosure, it will be appreciated by one with ordinary skill in the art that the present invention provides a number of advantages over the prior art, including, for example, that close cooperation between the nozzle mechanism and connector advantageously allows for a more controlled transfer of fluid to the container, which eliminates waste and the need for a separate cleaning step prior to completion. Furthermore, the connector and filling chamber are sterilized at the beginning of every fill cycle, there is a complete sterilization rinse cycle after a pre-set number of fills, and measurable and measured sterilization of all moving components is allowed for.

These and other features of the present invention are described more fully in the section titled DETAILED DESCRIPTION OF THE INVENTION, set forth below.

BRIEF DESCRIPTION OF THE DRAWING FIGURES

The present invention is herein described with reference to the following drawing figures, which are not necessarily to scale:

DETAILED DESCRIPTION OF THE INVENTION

Figure 1:
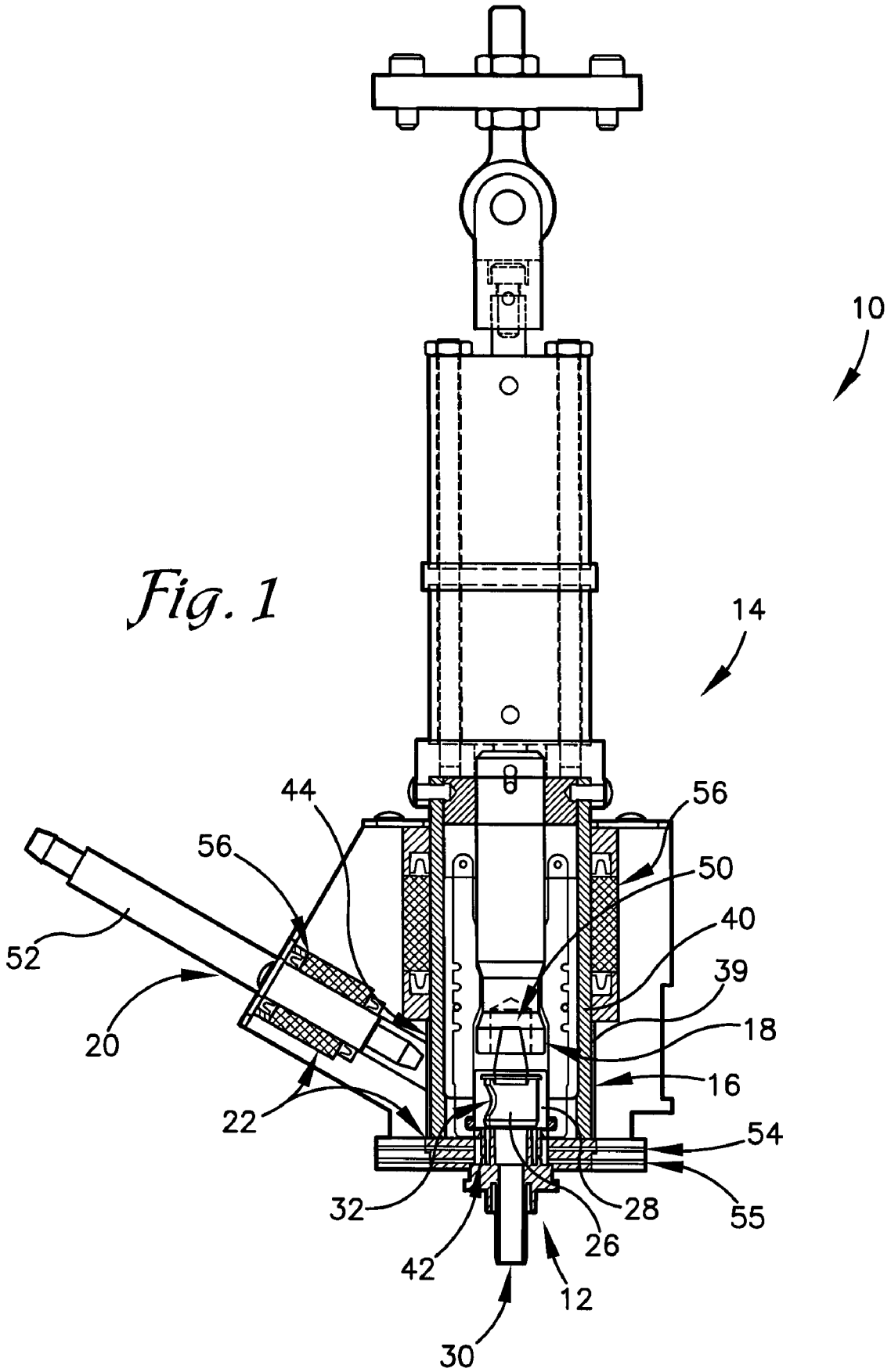
FIG. 1 is a sectional elevation view of an embodiment of the system of the present invention.

With reference to the drawing figures, a system and method is described, shown, and other disclosed herein in accordance with one or more preferred embodiments of the present invention. Broadly, the system and method allow for substantially automatically aseptically or non-aseptically filling a container with a fluid. In various exemplary applications, the container may be a bag, syringe, or cartridge, and may have a capacity of approximately between 25 milliliters and 10 liters, and the fluid may be a liquid, semi-liquid, gel, paste, powder, or other flowable form of material.

Whether a particular application requires aseptic or non-aseptic filling may depend on such factors as the nature of the fluid and the purpose for which the fluid will be used. For example, the present invention may be used to aseptically fill bags with biological or chemical reagents, medical products, or food products, or to non-aseptically fill bags with inks, cleaning products, or cosmetic products. For aseptic filling, the system 10 may be located within an enclosed and controlled space, such as, for example, a class 100 laminar flow hood. For non-aseptic filling, it may still be necessary or desirable to establish and maintain a particular filling environment so as to avoid introducing contaminants into the fluid, and the present invention allows for doing so.

Referring to FIG. 1, an embodiment of the system 10 broadly comprises a connector 12 and a filling machine 14, with the filling machine including a filling chamber 16; a removal mechanism 18; a nozzle mechanism 20; and a sterilization mechanism 22.

Figure 9:
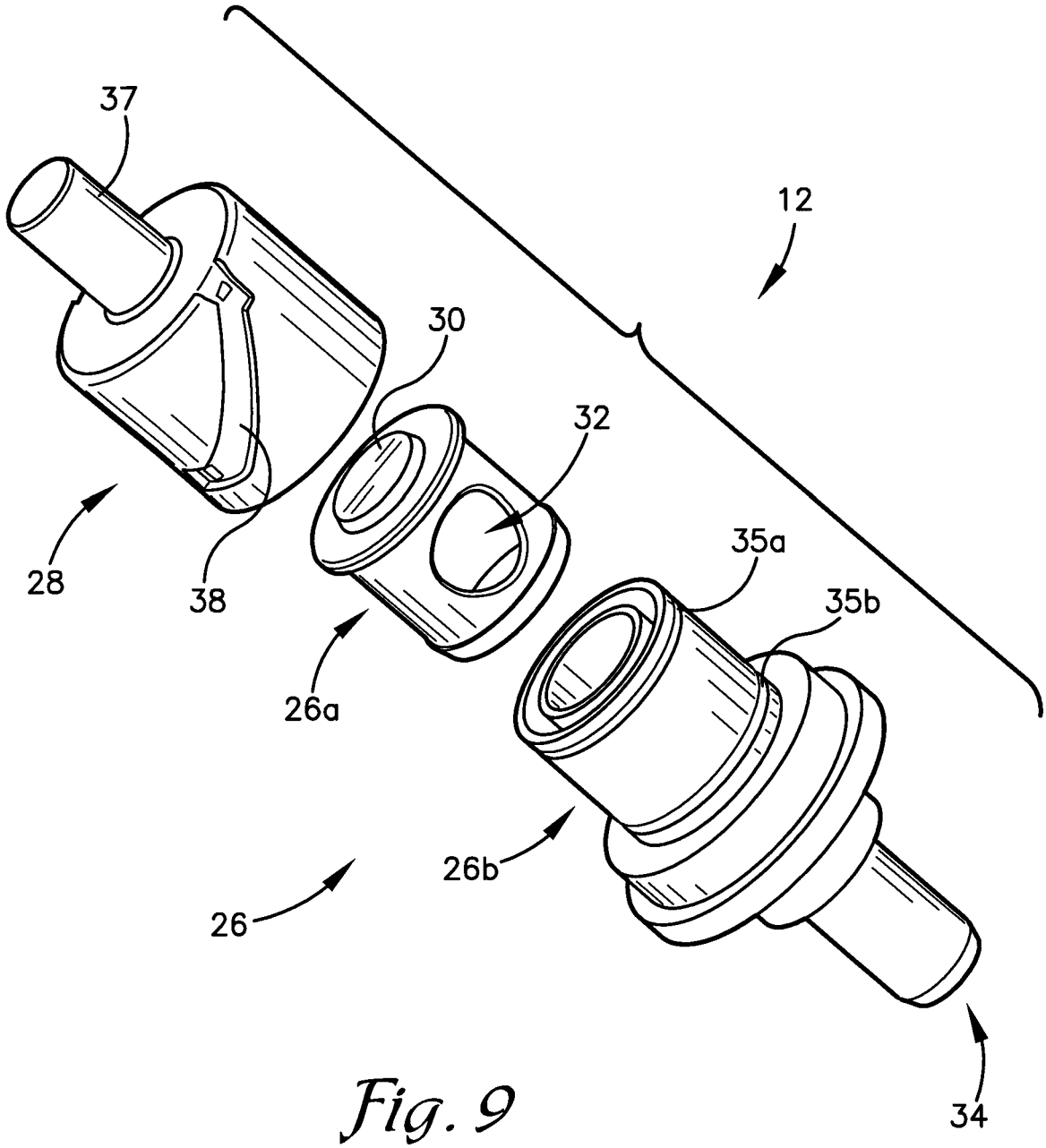
FIG. 9 is an exploded first perspective view of an embodiment of a connector portion of the system, wherein, in use, the connector is attached to a container.
Figure 10:
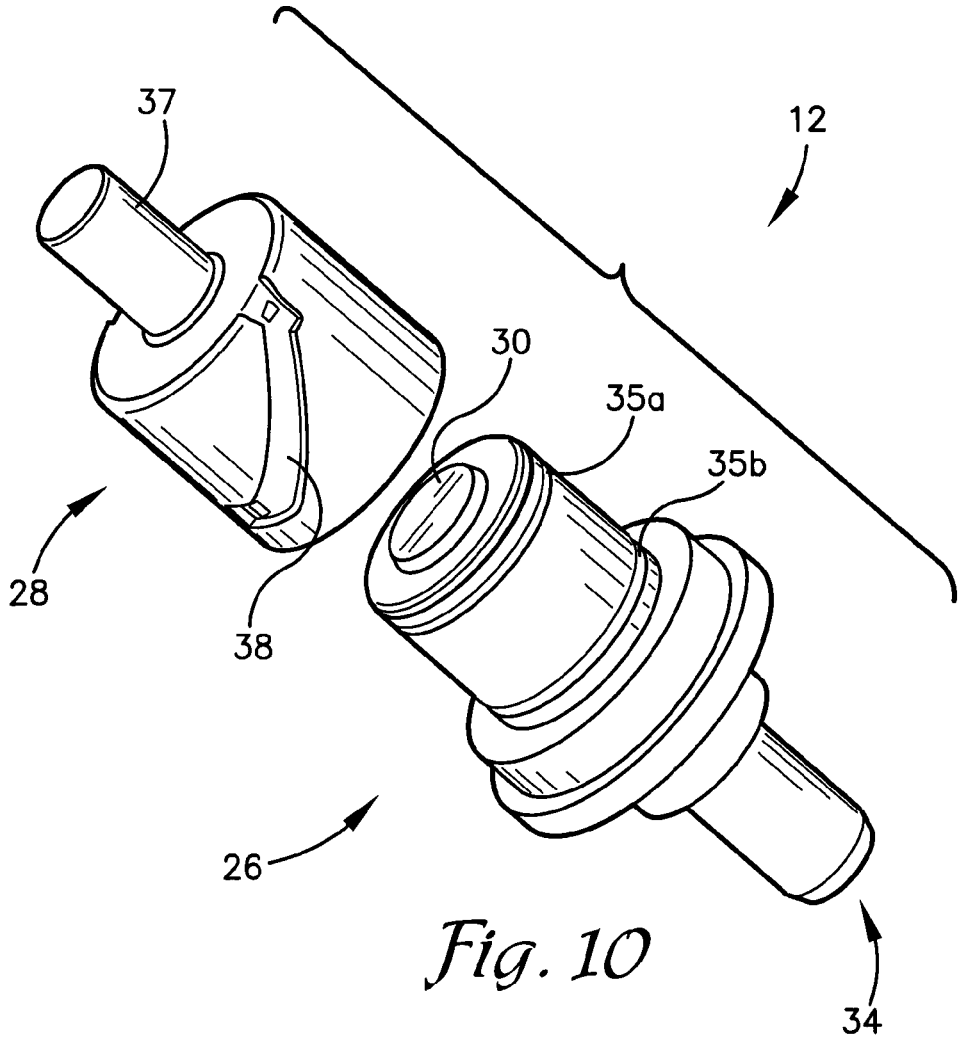
FIG. 10 is an exploded second perspective view of the connector of FIG. 9.
Figure 11:
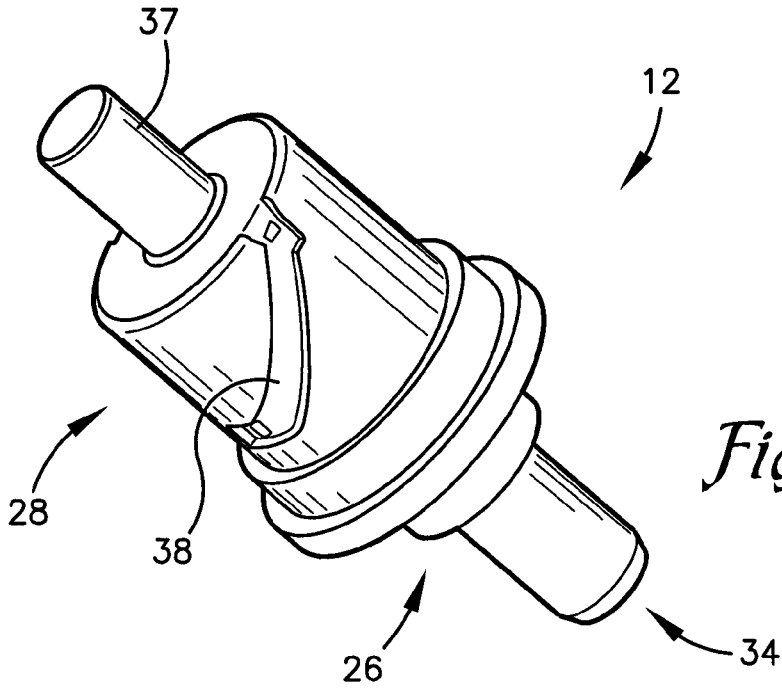
FIG. 11 is a third perspective view of the connector of FIG. 9.

Referring to FIGS. 9-11, the connector 12 provides an interface between the container and the filling machine 14. The connector 12 includes a fitting 26 and a locking mechanism 28. The fitting 26 includes an upper fitting portion 26*a* and a lower fitting portion 26*b*. The upper fitting portion 26*a* includes a top surface 30 and an side opening, or port 32, and may be constructed from any suitable material or combination of materials, including, for example, thermoplastic elastomer (TPE) material. The lower fitting portion 26*b* includes a lower opening 34 and first and second detent structures 35*a*,35*b*. Prior to filling, only a lower part of the upper fitting portion 26*a* is received within, or otherwise cooperates with, an upper part of the lower fitting portion 26*b*, and a fluid pathway extends through the connector 12 between the side opening 32 and the lower opening 34. Following filling, substantially the entire upper fitting portion 26*a* is received within, or otherwise cooperates with, the lower fitting portion 26*b*, as seen in FIG. 10, such that the side opening 32 is closed and only the top surface 30 of the upper fitting portion 26*a* is accessible. More specifically, the side opening 32 allows the fluid to flow from the filling machine 14 into the fitting 26 during filling, and the lower opening 34 allows the fluid to flow into and out of the container during filling and subsequent use, respectively. Thus, when it is desired to fill the container, the fluid is introduced at the side opening 32, flows through the pathway, and exits from the lower opening 34 into the container; and when it is desired to use the fluid, the fluid leaves the container and enters the lower opening 34, flows through the pathway, and exits a hole made in the top surface 30 of the upper fitting portion 26*a* (as described below).

The locking mechanism 28 prevents exposure of the fluid prior to use. The locking mechanism 28 presents a top projection 37, one or more external side channels 38, and one or more internal detent structures (not shown) which correspond to and cooperate with the first and second external detent structures 35*a*,35*b* of the fitting 26. Prior to filling, the detent structure of the locking mechanism 28 is engaged with the first, or uppermost, detent structure 35*a* of the fitting 26. During filling, the locking mechanism 28 is removed in order to facilitate access to the side opening 32 in the fitting 26. Following filling, the locking mechanism 28 is pushed fully down onto the fitting 26 such that the upper fitting portion 26*a* is pushed fully into the lower fitting portion 26*b*, as described above, and such that the detent structure of the locking mechanism 28 engages the second detent structure 35*b* of the fitting 26, thereby securing the connector 12 until ready for use. In one embodiment, the locking mechanism 28 includes two internal detent structures (not shown) which, when the locking mechanism 28 is pushed fully down upon the fitting 26, each engage a respective one of the first and second detent structures 35*a*,35*b* of the fitting 26, thereby providing twice the engagement.

Prior to use, the top projection 37 is removed, such as by breaking or cutting, thereby exposing the top surface 30 of the upper fitting portion 26*a*, and a cap (not shown) is fitted over the locking mechanism 28. The cap presents internal guide projections, an outlet, and an internal spike. The guide projections of the cap are received and move within the channels 38 of the locking mechanism 28 such that at a first uppermost channel location the spike within the cap is furthest from the top surface 30 of the upper fitting portion 26*a*, and at a second lowermost location the spike penetrates the top surface 30 to create an opening through which the liquid can exit.

Referring again to FIG. 1, the filling machine 14 allows for aseptically or non-aseptically filling the container via the above-described connector 12. As mentioned, the filling machine includes the filling chamber 16; the removal mechanism 18; the nozzle mechanism 20; and the sterilization mechanism 22.

The filling chamber 16 establishes and maintains a substantially enclosed or enclosable filling environment. The filling chamber 16 includes a stationary outer body 39 and a movable inner body 40, wherein the inner body 40 is slidably received within, or otherwise cooperates with, the outer body 39. The outer body 39 presents a lower opening 42 for closely receiving at least a portion of the connector 12 into the filling environment, and a side opening 44 for receiving the nozzle mechanism 20 into the filling environment. The inner body 40 cooperates closely with the outer body 39 and presents an opening corresponding to the lower opening 42 but does not present an opening corresponding to the side opening 44, such that when the inner body 40 is in a forward, or closed, position the side opening 44 is covered and the nozzle mechanism 20 is not exposed to the filling environment, and when the inner body 40 is in a rearward, or open, position the side opening 44 is uncovered and the nozzle mechanism 20 is exposed to the filling environment.

The removal mechanism 18 removes the locking mechanism 28 from the connector 12 to expose the side opening 32 in the fitting 26 for filling, and replaces the locking mechanism 28 once filling is complete. The removal mechanism 18 may be mechanical in nature, and use direct physical contact and/or manipulation, e.g., turning or pushing/pulling, to remove and replace the locking mechanism 28. In the embodiment shown in the figures, for example, the removal mechanism 18 is movable between first forward and rearward positions and includes a plurality of flexible or spring-loaded gripping structures 50, or fingers, that fit over and grip the locking mechanism 28. Additionally or alternatively, the removal mechanism 18 may use vacuum pressure to remove and replace the locking mechanism 28 and/or to retain the locking mechanism 28 while it is removed. Initially, the removal mechanism 18 moves to its forward position and grips the locking mechanism 28, then moves to the rearward position to remove the locking mechanism 28 and allow the nozzle mechanism 20 to interface with the side opening 32 in the fitting 26 during filling, and then moves back to the forward position to replace the locking mechanism 28 once filling is complete, as described above.

The nozzle mechanism 20 delivers the fluid from a fluid reservoir to the connector 12 during the filling process. The nozzle mechanism 20 includes a shaft 52 that is movable between a first, or filling, position in which a forward portion of the shaft 52 extends through the side opening 44 in the outer body 39 of the filling chamber 16 into the filling environment and into the side opening 32 in the fitting 26, and a second, or non-filling, position in which the forward portion of the shaft 52 is blocked from the filling environment by the inner body 40 of the filling chamber 16 in its forward position. As shown, the shaft 52 may intersect the filling chamber 16 angularly, such as, for example, at an angle of approximately between 30 degrees and 60 degrees, or, in one particular embodiment, 45 degrees, relative to the fitting 26.

The sterilization mechanism 22 sterilizes at least a portion of the connector 12 and the filling chamber 16, at the beginning of every fill cycle; conducts a complete sterilization rinse cycle after a pre-set number of fills; and allows for measurable and measured sterilization of all moving components. The sterilization mechanism 22 may use any suitable sterilizing technique, including, for example, the application of hydrogen peroxide to the surfaces to be sterilized. The sterilization mechanism 22 includes a sprayer component 54, an evacuation component 55, and a contact component 56. The sprayer component 54 sprays, or mists, the sterilizing liquid onto one or more of the surfaces to be sterilized, including the surfaces defining the filling environment. Depending on where the sprayer component 54 is located, it may be angled, such as upwardly or downwardly, in order to ensure proper dispersion of the mist throughout the filling environment. The evacuation component 55 evacuates any remaining airborne mist immediately prior to filling. The contact component 56 applies sterilizer directly to certain surfaces to be sterilized, especially portions of the moving parts that may be exposed to a non-sterile environment during the filling process, such as, for example, the side and upper surfaces of the connector 12, the shaft 52 of the nozzle mechanism 20, and a rearward portion of the inner body 40 of the filling chamber 16. The sprayer and contact components 54,56 may draw sterilizing liquid from a reservoir, wherein the sprayer component 54 does so through pumping action and the contact components 56 do so through wicking action. For non-aseptic filling, the sterilization mechanism 22 may be eliminated or replaced with some other appropriate mechanism for conditioning or controlling the filling environment. For example, in one embodiment for non-aseptic filling, the sterilization mechanism is replaced with a cleaning mechanism in which a cleaning fluid is introduced via the sprayer and/or applied via the contact components.

Figures 2, 3, 4, 5, 6, 7:
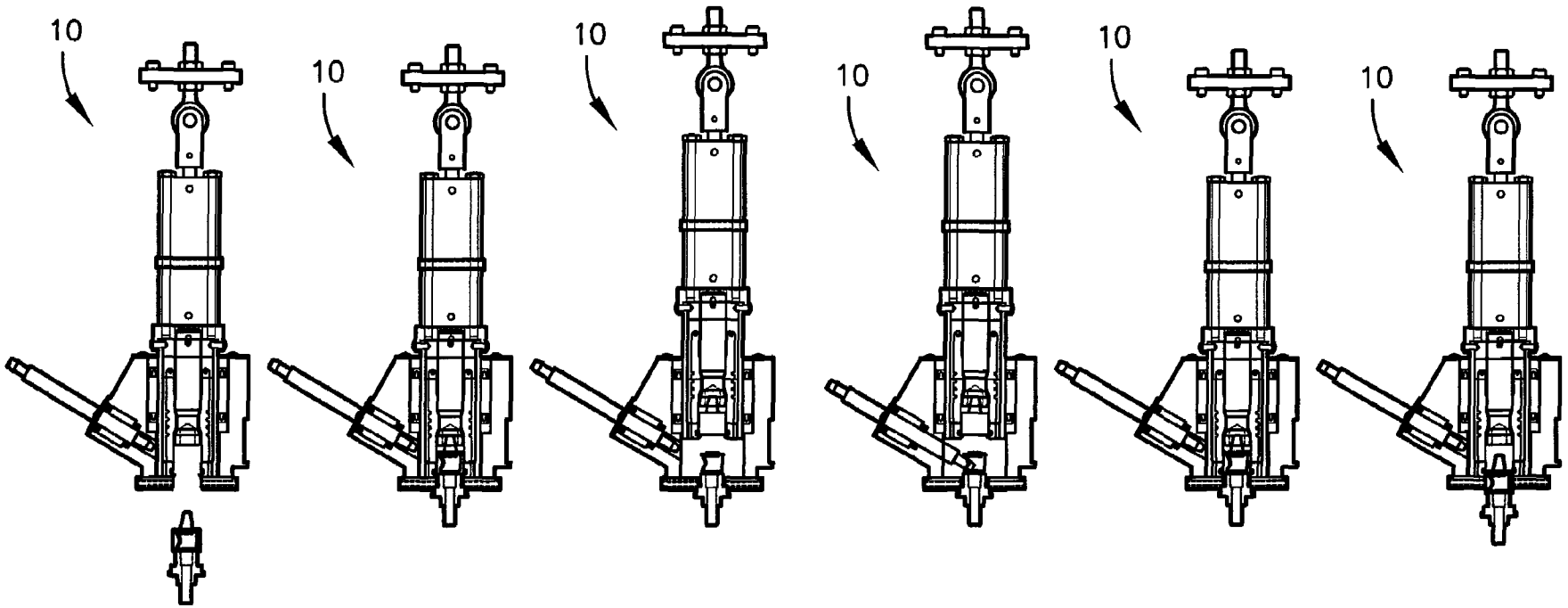
FIG. 2 is a sectional elevation view of the system of FIG. 1 shown in a first stage of operation.
FIG. 3 is a sectional elevation view of the system of FIG. 1 shown in a second stage of operation.
FIG. 4 is a sectional elevation view of the system of FIG. 1 shown in a third stage of operation.
FIG. 5 is a sectional elevation view of the system of FIG. 1 shown in a fourth stage of operation.
FIG. 6 is a sectional elevation view of the system of FIG. 1 shown in a fifth stage of operation.
FIG. 7 is a sectional elevation view of the system of FIG. 1 shown in a sixth stage of operation.

In exemplary use and operation, the system 10 may function substantially as follows, with reference to FIGS. 2-7. Initially, the nozzle mechanism 20 is in the second position, and the inner body structure 40 of the filling chamber 16 is in the forward position, as shown in FIG. 2. At least the locking mechanism 28 and upper fitting portion 26*a* of the fitting 26 of the connector 12 are received within the lower opening 42 of the filling chamber 16, as shown in FIG. 3. In so doing, the contact component 56 of the sterilizing mechanism 22 applies the sterilizing liquid to at least a portion of the connector 12. The spray component 54 of the sterilizing mechanism 22 introduces a spray, or mist, of sterilizing liquid into the filling chamber 16. Shortly thereafter, any of the mist still airborne is evacuated from the filling chamber 16, such as by vacuum suction. Next, the removal mechanism 18 moves to its forward position and grips the locking mechanism 28 of the connector 12. Then, the removal mechanism 18 moves to its rearward position and thereby removes the locking mechanism 28 and exposes the side opening 32 in the fitting 26 of the connector 12, as shown in FIG. 4. At substantially the same time, the inner body 40 of the filling chamber 16 moves to its rearward position, thereby uncovering the side opening 44 in the outer body structure 39 and exposing the nozzle mechanism 20 to the filling environment. Next, the shaft 52 of the nozzle mechanism 20 moves to its first position, and thereby extends through the side opening 44 in the outer body 39 of the filling chamber 16 and into the side opening 32 in the fitting 26 of the connector 12, as shown in FIG. 5. The liquid is then transferred through the shaft 52, into and through the passageway through the fitting 26, and into the container. This movement of the fluid may be accomplished using any suitable mechanism, such as a diaphragm pump or a peristaltic pump. Then, once the container is filled with the fluid, the shaft 52 moves back to its second position, the inner body 40 moves back to its forward position, and the removal mechanism 18 moves back to its forward position and replaces the locking mechanism 28 in the closed position, as described above, as shown in FIGS. 6 and 7. Lastly, the removal mechanism 18 releases the locking mechanism 28 so that the connector 12 can be withdrawn from the filling machine 14 and a new container can be placed in position for filling.

Figure 8:
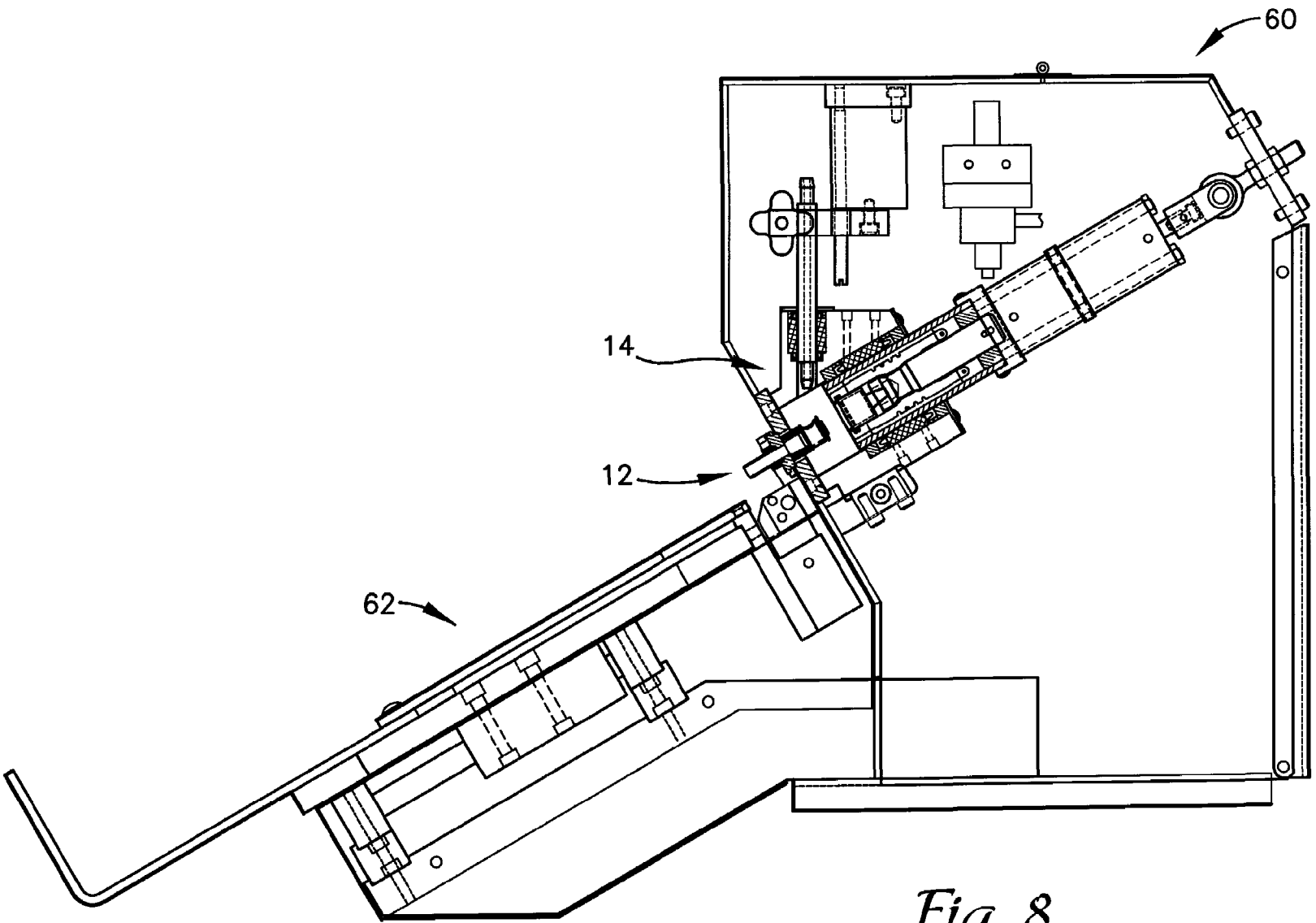
FIG. 8 is a sectional elevation view of the system of FIG. 1 shown in combination with an embodiment of a mounting and support structure.

Referring to FIG. 8, the filling machine 14 is shown mounted on or otherwise combined with a mounting and support structure 60,62. The mounting portion 60 securely receives and maintains the filling machine 14 in an orientation such that the shaft 52 of the nozzle mechanism 20 is maintained substantially vertical in order to control dripping of the fluid therefrom, and the support structure 62 maintains the container in a correspondingly angled orientation. The support portion 62 includes a container-supporting shelf for receiving and retaining the container during the filling process. In one embodiment, the system 10 and mounting and support structure 60,62 together have a benchtop area, or "footprint", of approximately 12 inches by 12 inches.

In one embodiment, multiple instances of the filling machine 10 are coupled with the same fluid reservoir to allow fluid to be transferred therefrom to multiple containers simultaneously.

Referring to FIGS. 12-17, a second embodiment of the system 110 broadly comprises the connector 12 and the filling machine 114, with the filling machine including the filling chamber 116; the removal mechanism 118; and the nozzle mechanism 120. The system 110 is shown in combination with the mounting and support structures 160, 162.

This embodiment does not include an integrated sterilization mechanism. Instead, when aseptic filling is desired, the filling machine 114 is placed within an appropriately controlled environment, such as a laminar flow hood. As such, the filling chamber 116 of this embodiment takes the form of a removable shroud 117 operable to prevent inadvertent direct and contaminating contact with the shaft 152 of the nozzle mechanism 120.

Figure 12:
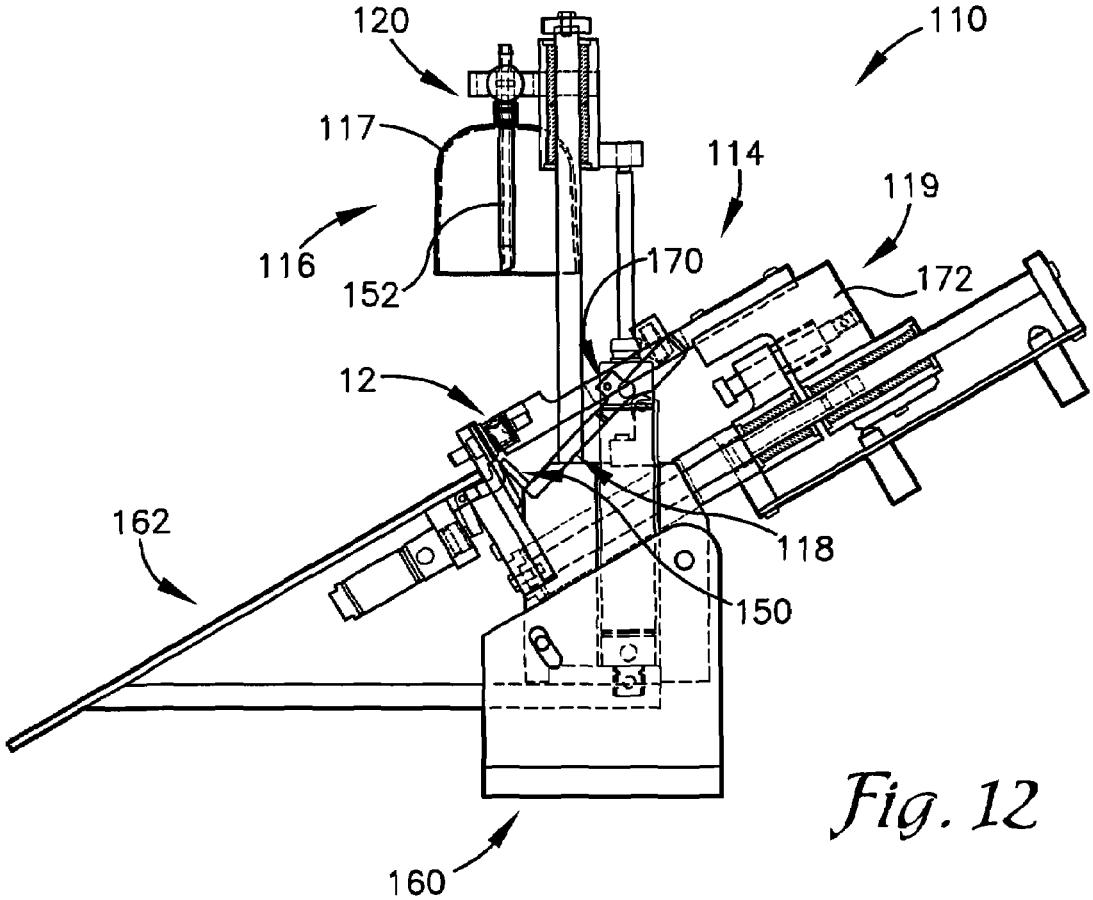
FIG. 12 is a sectional elevation view of a second embodiment of the system of the present invention shown in a first stage of operation.
Figure 13:
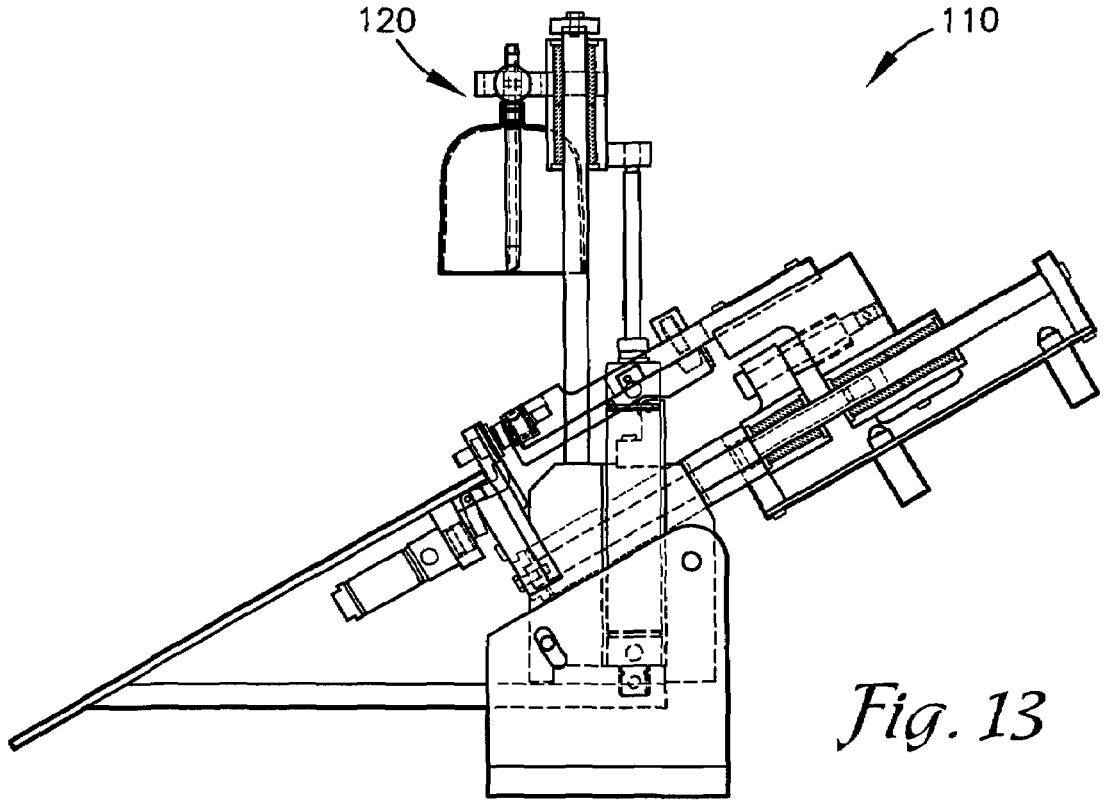
FIG. 13 is a sectional elevation view of the system of FIG. 12 shown in a second stage of operation.
Figure 14:
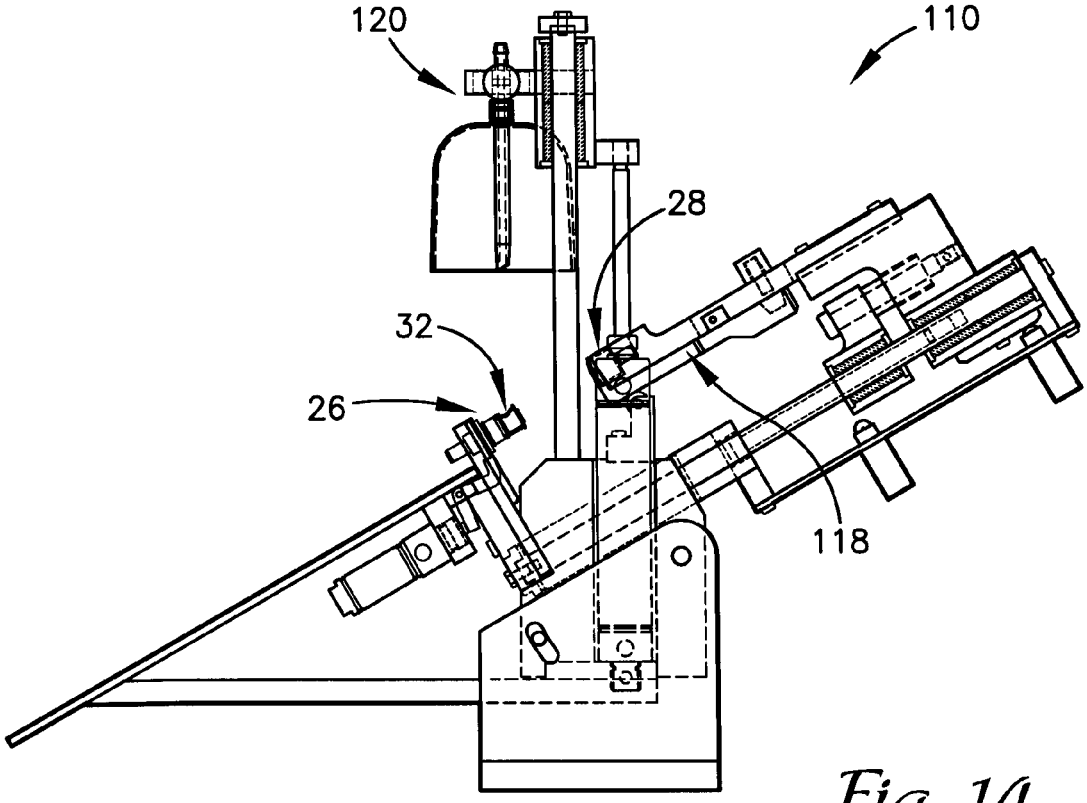
FIG. 14 is a sectional elevation view of the system of FIG. 12 shown in a third stage of operation.

The removal mechanism 118 of this embodiment performs substantially the same function as the removal mechanism 18 discussed above, but in a different manner. In the embodiment shown in the figures, for example, the removal mechanism 118 includes angled fingers 150 for fitting between the locking mechanism 28 and the container, and has two movement profiles. In one embodiment, the angled fingers 150 are angled at approximately 90 degrees relative to the remainder of the removal mechanism 118. The first movement profile involves pivot-type movement in which the angled fingers 150 move from a position substantially adjacent the locking mechanism 28, as shown in FIG. 12, to a position substantially between the locking mechanism 28 and the container, as shown in FIG. 13. The second movement profile involves substantially linear-type movement in which the angled fingers 150 move from a position substantially adjacent the container, as shown in FIG. 13, to a position spaced apart from the container, as shown in FIG. 14, wherein, in moving away from the container, the angled fingers 150 disengage and move the locking mechanism 28 away from the fitting 26 and container as well, thereby exposing the side opening 32 in the fitting 26 for filling. Once filling is complete, the second movement profile is reversed to replace the locking mechanism 28 onto the fitting 26, and then the first movement profile is reversed to reengage the locking mechanism 28 with the fitting 26 and then disengage the removal mechanism 118 from the locking mechanism 28.

Also shown is a pivot and extension/retraction mechanism 119 for substantially automatically accomplishing movement of the removal mechanism 118 along the first and second movement profiles, both forward and reverse. In the embodiment shown in the figures, for example, the pivot and extension/retraction mechanism 119 includes a pivot point and mechanism 170 for accomplishing the first movement profile, and an arm 172 coupled at one end with the removal mechanism 118 and coupled at an opposite end to a source of substantially linear motion which may be, for example, electrical, mechanical, hydraulic, or pneumatic in nature.

The nozzle mechanism 120 of this embodiment performs substantially the same function as the nozzle mechanism 20 discussed above. More specifically, the shaft 152 is movable between a first, or filling, position in which a forward portion of the shaft 152 extends into the side opening 32 in the fitting 26, and a second, or non-filling, position in which the shaft 152 is retracted. As shown, the shaft 52 may intersect the filling chamber 16 angularly, such as, for example, at an angle of approximately between 30 degrees and 60 degrees, or, in one particular embodiment, 45 degrees, relative to the fitting 26. As discussed above, the mounting structure 60 maintains the filling machine 114 in an orientation such that the shaft 152 is maintained substantially vertical in order to control dripping of the fluid therefrom, and the support structure 62 maintains the container in a correspondingly angled orientation.

Also shown is an extension/retraction mechanism 121 for substantially automatically extending and retracting the shaft 152. In the embodiment shown in the figures, for example, the extension/retraction mechanism 121 includes an arm coupled at one end with the shaft 152 and coupled at an opposite end to a source of substantially linear motion which may be, for example, electrical, mechanical, hydraulic, or pneumatic in nature.

In exemplary use and operation, the system 110 may function substantially as follows. Initially, the nozzle mechanism 120 is retracted and the angled fingers 150 of the removal mechanism 118 are substantially adjacent the locking mechanism 28, as shown in FIG. 12. Next, the removal mechanism 118 moves along its first movement profile until the angled fingers move to a position substantially between the locking mechanism 28 and the container, as shown in FIG. 13. Then, the removal mechanism 118 moves along its second movement profile away from the container until the locking mechanism 28 is removed from the fitting 26 and the side opening 32 is exposed for filling, as shown in FIG. 14.

Figure 15:
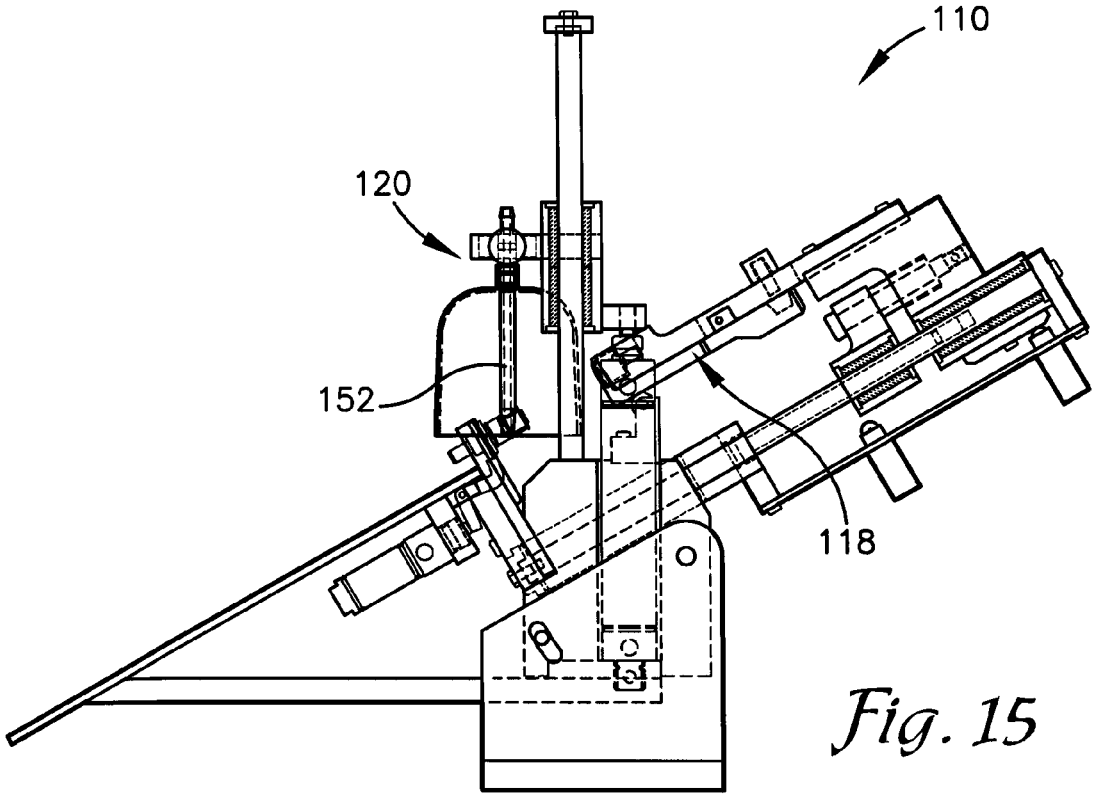
FIG. 15 is a sectional elevation view of the system of FIG. 12 shown in a fourth stage of operation.
Figure 16:
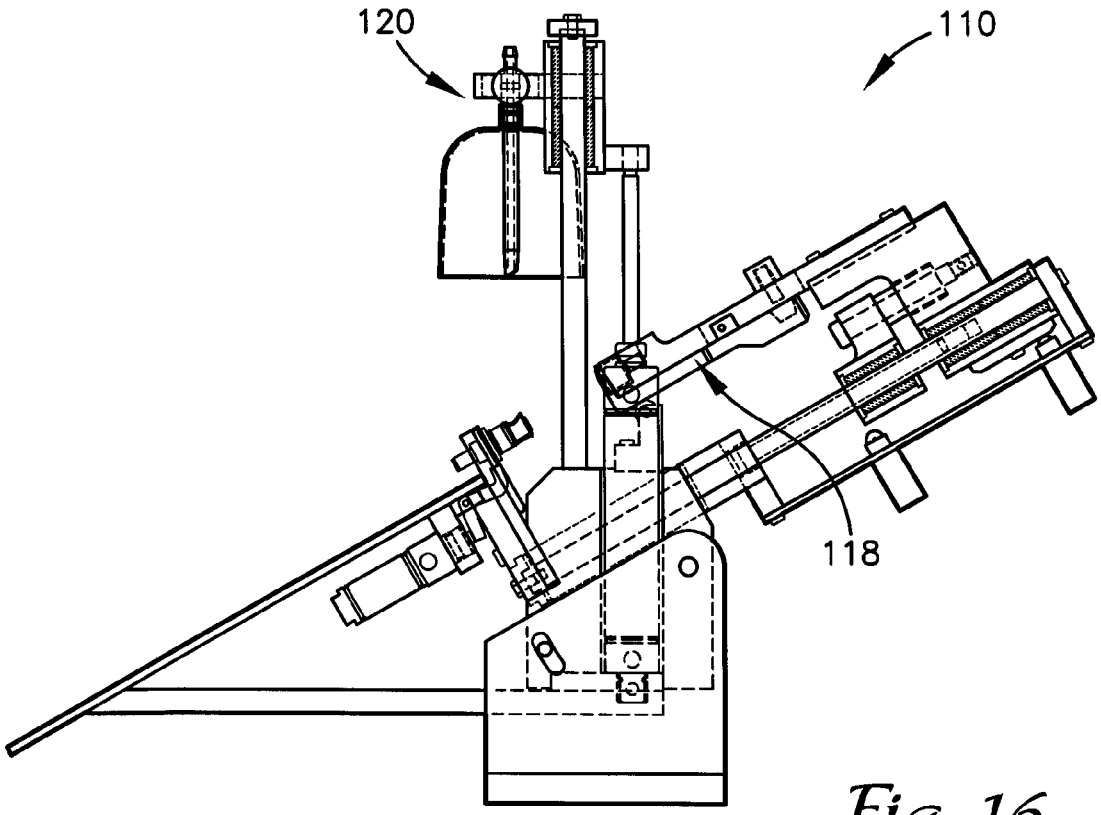
FIG. 16 is a sectional elevation view of the system of FIG. 12 shown in a fifth stage of operation.

Next, the shaft 152 of the nozzle mechanism 120 extends to its first, or filling, position in which the forward portion of the shaft 152 extends into the side opening 32 in the fitting 26, as shown in FIG. 15. The liquid is then transferred through the shaft 152, into and through the passageway through the fitting 26, and into the container. This movement of the fluid may be accomplished using any suitable mechanism, such as a diaphragm pump or a peristaltic pump. Then, once the container is filled with the fluid, the nozzle mechanism 120 is retracted to its second, or non-filling, position, as shown in FIG. 16.

Figure 17:
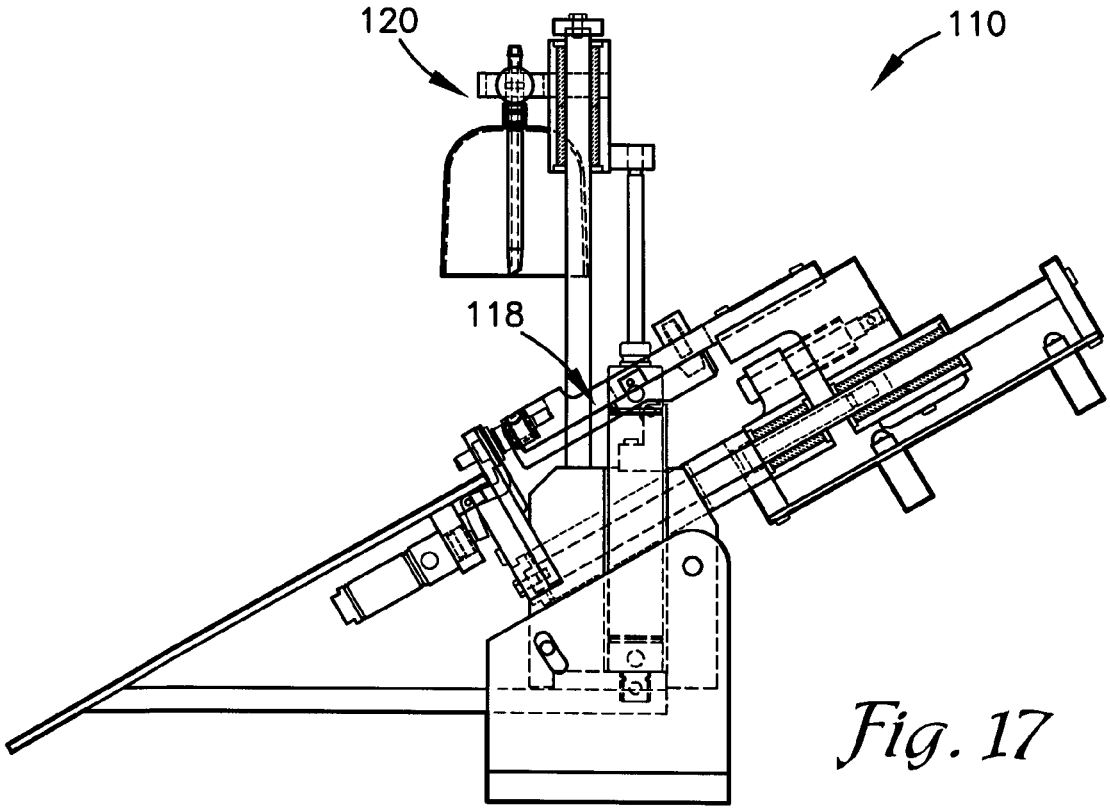
FIG. 17 is a sectional elevation view of the system of FIG. 12 shown in a sixth stage of operation.

Next, the removal mechanism 118 moves in reverse along its second movement profile to replace the locking mechanism 28 onto the fitting 26, as shown in FIG. 17. Then, the removal mechanism 118 moves in reverse along its first movement profile to disengage the removal mechanism 118 from the locking mechanism 28. Thereafter, the filled container is removed from the filling machine 114 and a new container is positioned for filling.

It is contemplated that, for both the first and second embodiments, the filling operation may be substantially automatically accomplished by a computing device controlling appropriate intermediate structures. For example, the various movements of the various structures, the timing and degree of the sterilization process of the first embodiment, and the timing and amount of the liquid injected into the container via the nozzle mechanism 20,120 may all be accomplished by arms, linkages, motion sources, and valves substantially automatically controlled by the computing device in accordance with pre-established instructions. The pivot and extension/retraction mechanism 119 for the removal mechanism 118, and the extension/retraction mechanism 121 for the nozzle mechanism 120, are examples of such intermediate structures.

From the foregoing discussion, it will be appreciated by one with ordinary skill in the art that the present invention provides a number of advantages over the prior art, including, for example, that close cooperation between the nozzle mechanism and connector allows for a more controlled transfer of fluid to the container, which eliminates waste and the need for a separate cleaning step prior to completion. Furthermore, in the first embodiment, the connector and filling chamber are sterilized at the beginning of every fill cycle, there is a complete sterilization rinse cycle after a pre-set number of fills, and measurable and measured sterilization of all moving components is allowed for. For these and other reasons, the present invention allows for more quickly and efficiently filling containers.

Although the invention has been disclosed with reference to various particular embodiments, it is understood that equivalents may be employed and substitutions made herein without departing from the scope of the invention as recited in the claims.

Having thus described the preferred embodiment of the invention, what is claimed as new and desired to be protected by Letters Patent includes the following:

1. A system for filling a container with a fluid, the system comprising:

a container comprising an attached connector including a fitting having a side opening; and a filling machine including a nozzle mechanism which is movable to enter the side opening in the fitting to transfer the fluid therethrough into the container and further including a filling chamber including—an outer body including a bottom opening for receiving at least a portion of the connector, and a side opening for receiving the nozzle mechanism; and an inner body slidably received within the outer body and movable between a first position in which the inner body blocks the side opening in the outer body, and a second position in which the inner body does not block the side opening in the outer body; and a sterilization mechanism for sterilizing the connector and the filling chamber, the sterilization mechanism including—a sprayer component for spraying a sterilizing liquid into the filling chamber; an evacuation component for evacuating an airborne portion of the sterilizing liquid prior to filling the container; and a contact component for applying the sterilizing liquid directly to at least a portion of the connector wherein the sprayer component pumps the sterilizing liquid from a reservoir, and the contact component wicks the sterilizing liquid from the reservoir.

2. The system as set forth in claim 1, wherein the fitting includes an upper fitting portion and a lower fitting portion which cooperate to expose the side opening in the fitting for filling the container, and which cooperate to block the side opening in the fitting once the container is filled.

3. The system as set forth in claim 2, wherein the fitting further includes a top surface which is puncturable to access the fluid within the filled container.

4. The system as set forth in claim 1. wherein the connector includes a locking mechanism positioned over the fitting.

5. The system as set forth in claim 4, wherein the locking mechanism includes one or more external side channels for cooperating with a cap.

6. The system as set forth in claim 4, wherein the filling machine further includes a removal mechanism for removing the locking mechanism from the fitting to expose the side opening in the fitting for filling the container, and for replacing the locking mechanism once the container is filled.

7. The system as set forth in claim 6, wherein the removal mechanism includes a plurality of gripping structures for gripping the locking mechanism.

8. The system as set forth in claim 6, wherein the removal mechanism includes a plurality of lingers for insertion between the locking mechanism and the container.

9. The system as set forth in claim 1, wherein the nozzle mechanism includes a shaft movable between a first position in which the shaft extends into the side opening in the fitting, and a second position in which the shaft does not extend into the side opening in the fitting, and wherein the fitting is oriented approximately between 30 degrees and 60 degrees relative to the shaft.

10. The system as set forth in claim 9, wherein the shaft is oriented substantially 'vertically.

11. The system as set forth in claim 1, wherein the nozzle mechanism includes a shaft movable between a first position in which the shaft extends through the side opening in the outer body of the tilling chamber and into the side opening in 20 the fitting, and a second position in which the shaft does not extend through the opening in the outer body of the fining chamber.

12. The system as set forth in claim 1, wherein the contact component also applies the sterilizing liquid directly to at least a portion of the nozzle mechanism.

13. A system for filling a container with a fluid, the system comprising a container; a connector attached to the container and including fitting having a side opening, the fitting including an upper fitting portion and a lower fitting portion which cooperate to expose the side opening in the fitting for filling the container, and which cooperate to block the side opening in the fitting once the container is filled; and a locking mechanism positioned over the fitting; and a filling machine including a removal mechanism operable to remove the locking mechanism from the fitting to expose the side opening in the fitting for filling the container, and operable to replace the locking mechanism once the container is filled, and a nozzle mechanism including a shaft movable between a first position in which the shaft extends into the side opening in the fitting, and a second position in which the shaft does not extend into the side opening in the fitting, and wherein the fitting is oriented approximately between 30 degrees and 60 degrees relative to the shaft.

14. The system as set forth in claim 13, wherein the removal mechanism includes a plurality of fingers for insertion between the locking mechanism and the container.

15. The system as set forth in claim 13, wherein the fitting is oriented approximately 45 degrees relative to the shaft.

16. The system as set forth in claim 13, wherein the shaft is oriented substantially vertically.

17. The system of claim 13, wherein the filling machine further includes a filling chamber including an outer body including a bottom opening for receiving at least a portion of the connector, and a side opening for receiving the nozzle mechanism; and an inner body slidahly received within the outer body and movable between a first position in which the inner body blocks the side opening in the outer body, and a second position in which the inner body does not block the side opening in the outer body.

18. The system of claim 13, wherein the filling machine further includes a sterilization mechanism for sterilizing the connector and the filling chamber, the sterilization mechanism including a sprayer component for spraying a sterilizing liquid into the filling chamber; an evacuation component for evacuating an airborne portion of the sterilizing liquid prior to filling the container; and a contact component for applying the sterilizing liquid directly to at least a portion of the connector.

19. The system of claim 18, wherein, the sprayer component pumps the sterilizing liquid from a reservoir, and the contact component wicks the sterilizing liquid from the reservoir.

20. A method of filling a container with a liquid, the method comprising the steps of:

(a) removing a locking mechanism from a fitting connected to the container to expose a side opening in the fitting;

(b) moving a shaft into the side opening in the fitting, wherein the shaft is oriented substantially vertically and the fitting is oriented approximately between 30 degrees and 60 degrees relative to the fitting;

(d) transferring fluid into the container via the shaft and the fitting; (e) removing the shaft from the side opening in the fitting; and (f) replacing the locking mechanism on the fitting.

* * * * *